US008156863B1

(12) United States Patent
Wilson

(10) Patent No.: US 8,156,863 B1
(45) Date of Patent: Apr. 17, 2012

(54) WASTE RECEPTACLE WITH INTEGRAL MANUAL WASTE COMPRESSOR AND ASSOCIATED METHOD

(76) Inventor: Gwendolyn M. Wilson, Fullerton, CA (US)

( * ) Notice: Subject to any disclaimer, the term of this patent is extended or adjusted under 35 U.S.C. 154(b) by 123 days.

(21) Appl. No.: 12/541,654

(22) Filed: Aug. 14, 2009

Related U.S. Application Data

(60) Provisional application No. 61/189,263, filed on Aug. 15, 2008.

(51) Int. Cl.
*B30B 1/04* (2006.01)
*B30B 15/06* (2006.01)

(52) U.S. Cl. ..... 100/226; 100/99; 100/229 A; 100/246; 100/265; 100/295

(58) Field of Classification Search ..... 100/99, 100/226, 227, 228, 229 A, 240, 245, 246, 100/247, 265, 295; 220/908
See application file for complete search history.

(56) References Cited

U.S. PATENT DOCUMENTS 2,533,282 A * 12/1950 Osman ..... 222/387
3,760,718 A * 9/1973 Adornetto ..... 100/227
3,779,157 A * 12/1973 Ross et al. ..... 100/240
3,946,662 A * 3/1976 Ross et al. ..... 100/240
5,090,309 A * 2/1992 Lai ..... 100/226
5,730,047 A * 3/1998 Lindsey ..... 100/90
5,857,408 A * 1/1999 Witter ..... 100/265
5,960,983 A 10/1999 Chan
6,554,149 B2 4/2003 Schneider
6,616,004 B1 9/2003 Erickson
7,237,480 B2 * 7/2007 Ruddock ..... 100/226
7,299,746 B2 * 11/2007 LaPorte ..... 100/226

* cited by examiner

*Primary Examiner* — Jimmy T Nguyen

(57) ABSTRACT

A manually-actuated waste compressing system includes a waste receptacle; a waste bag; a lid removably mated to the waste receptacle and a compression implement. The manually-actuated compression implement includes an elongated dowel and a disc, and is centrally aligned within an inner perimeter of the waste receptacle and linearly reciprocated along a linear travel path of the waste receptacle to compress garbage contained within the receptacle. A light source is electrically communicated by a pair of contacts and alerts a user when an undesirable compression of the garbage is reached. The apparatus provides the benefit of compacting garbage without having to make direct contact therewith thus allowing more garbage to be stored within the waste receptacle before disposal. The light source additionally ensures that the apparatus may not be unduly damage by excessive pressure when compacting garbage.

10 Claims, 7 Drawing Sheets

WASTE RECEPTACLE WITH INTEGRAL MANUAL WASTE COMPRESSOR AND ASSOCIATED METHOD

CROSS REFERENCE TO RELATED APPLICATIONS

This application claims the benefit of U.S. Provisional Application No. 61/189,263, filed Aug. 15, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to waste receptacles and, more particularly, to a waste receptacle compression system having a compressor implement cooperatively engaged with a waste receptacle holding a trash bag therein.

2. Prior Art

There are, at present, a wide variety of waste containers available to the consumers. One such waste container incorporates a cover which is lifted by operating a pedal device. Another type of waste container incorporates means for easily replacing a waste bag provided in the waste container. A waste container is easily filled up since garbage, especially cartons and cans, occupy a lot of space when thrown away in their original shapes and sizes. Garbage inside the waste container must therefore be compressed to permit accommodation of more garbage. Conventionally, compression of garbage is done manually, either by hand or foot. Such a procedure is unsanitary and is, in most cases, distasteful.

As such, many systems have been developed for collecting and compressing trash. However, most of them are motor driven, and so expensive, noisy and large. Being designed to crush or compress everything put into them, they have more power than is required for most purposes. Those that are not motor driven are either primarily aimed at can crushing alone or, if for general trash collection, they are inefficient and costly. The size and expense of motorized systems makes it impractical to have multiple units so that trash can be sorted.

Accordingly, a need remains for a waste receptacle compression system in order to overcome the above-noted shortcomings. The present invention satisfies such a need by providing a device that is convenient and easy to use, is durable yet lightweight in design, is versatile in its applications, and provides users with a convenient means of compacting garbage without having to make direct contact therewith.

BRIEF SUMMARY OF THE INVENTION

In view of the foregoing background, it is therefore an object of the present invention to provide an apparatus for providing users with a convenient means of compacting garbage without having to make direct contact therewith. These and other objects, features, and advantages of the invention are provided by a waste receptacle with integral manual waste compressor.

In a preferred embodiment of the present invention, a manually-actuated waste compressing system may preferably include a waste receptacle. The waste receptacle preferably adapted to house the waste therein and having a waste bag removably seated within. The system may preferably include a lid removably mated to the waste receptacle and a manually-actuated compression implement which may be linearly reciprocated along a linear travel path defined along a longitudinal length of the waste receptacle. The compression implement may preferably be centrally aligned within an inner perimeter of the waste receptacle during reciprocating movements of the compression implement.

Further, the compression implement may include an elongated rectilinear dowel provided with a knob attached to its proximal end, and a disc situated subjacent to the lid. The disc may be coupled to a distal end of the dowel wherein the disc is suitably sized and shaped to linearly slide within close proximity of the inner perimeter of the waste receptacle. The disc may be further adapted to downwardly compact the waste within the waste bag while the lid remains elevated above of the waste receptacle.

In addition, the lid may preferably be statically mated to the compression implement and may be removably engaged with a top opening of the receptacle as the disc is reciprocated along the linear travel path. The lid and the disc may preferably have fixed diameters and be coaxially spaced apart along a longitudinal length of the dowel such that the disc and the lid may be synchronously displaced along a linear travel path as the dowel is reciprocated along the linear travel path.

In one embodiment, the compression implement may include a light-emitting source located at the knob and a power supply source electrically coupled to the light-emitting source. A deformably resilient spring member preferably having axially opposed ends may further be directly anchored to an inner chamber of the dowel and the disc respectively such that the spring member may exert a resistive force against a linear motion of the dowel.

Further, a pair of conductive contacts may be statically connected to the dowel and the disc respectively. In this way, when the spring member is reciprocated between compressed and equilibrium positions as the dowel is linearly reciprocated along the linear travel path, the contacts may be directly engaged when the spring member is compressed along the linear travel path such that the light emitting source is illuminated when the contacts are directly engaged.

In this manner, a user may learn of a maximum bottom displacement point of the dowel during compression procedures. Such a system has a distinct advantage in that it allows a user to be alerted to use an optimum compression force to compact the garbage. This will ensure that the garbage may not be overly compressed such as to damage the waste receptacle or compression implement respectively.

In one embodiment, the system may further include a plurality of hooks oppositely located at an open top end of the receptacle. The waste bag preferably having a pair of upper flanges removably mated to the hooks such that the waste bag is held at an upright position for receiving the waste therein. The hooks may further be diametrically opposed along the inner perimeter of the open top end such that they are caused to automatically rotate inwardly from the inner perimeter when the compression implement is removed from the waste receptacle.

In addition, the hooks are rotatably urged along mutually exclusive arcuate paths and thereby face outwardly away from the inner perimeter when the disc is lowered into the waste receptacle. In this way, the waste bag may preferably be tensioned when the hooks rotate outwardly away from the inner perimeter so that the disc evenly compresses the waste towards a bottom end of the waste bag.

In one embodiment, each of the disc and the lid may preferably include an inner ring concentrically positioned about the dowel and an outer ring rotatably mated to the inner ring and spaced away from the dowel. The inner ring may preferably have a predetermined fixed diameter. The outer ring may preferably include a plurality of arcuate segments dynamically arranged at an end-to-end pattern extending along a circumference of the outer ring with each of the arcuate segments preferably equidistantly offset from a center of the inner ring.

Such a configuration may preferably allow a diameter of the outer ring to uniformly increased and decreased as the arcuate segments are spatially separated and connected at the end-to-end pattern respectively. Additionally, each of the diameters of the outer rings associated with the lid and the disc may be independently increased and decreased as desired by the user.

The invention may further include a method of utilizing a manually-actuated waste compressing system for effectively compacting waste in a space-limited target zone. The method may preferably comprise the chronological steps of providing a waste receptacle; providing and removably seating a waste bag within the waste receptacle wherein the waste bag is adapted to house the waste therein; providing and removably mating a lid to the waste receptacle; providing and linearly reciprocating a manually-actuated compression implement along a linear travel path defined along a longitudinal length of the waste receptacle such that the compression implement is centrally aligned within an inner perimeter of the waste receptacle during reciprocating movement.

The compression implement may further include the step of providing an elongated rectilinear dowel provided with a knob attached to a proximal end thereof, and a disc situated subjacent to the lid and coupled to a distal end of the dowel. Further, the lid may be statically mated to the compression implement; compacting the waste by downwardly compacting the disc within the waste bag and thereby linearly sliding the disc within close proximity of the inner perimeter of the waste receptacle while the lid remains elevated above of the waste receptacle; and in addition, removably engaging the lid with a top opening of the receptacle as the disc is reciprocated along the linear travel path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
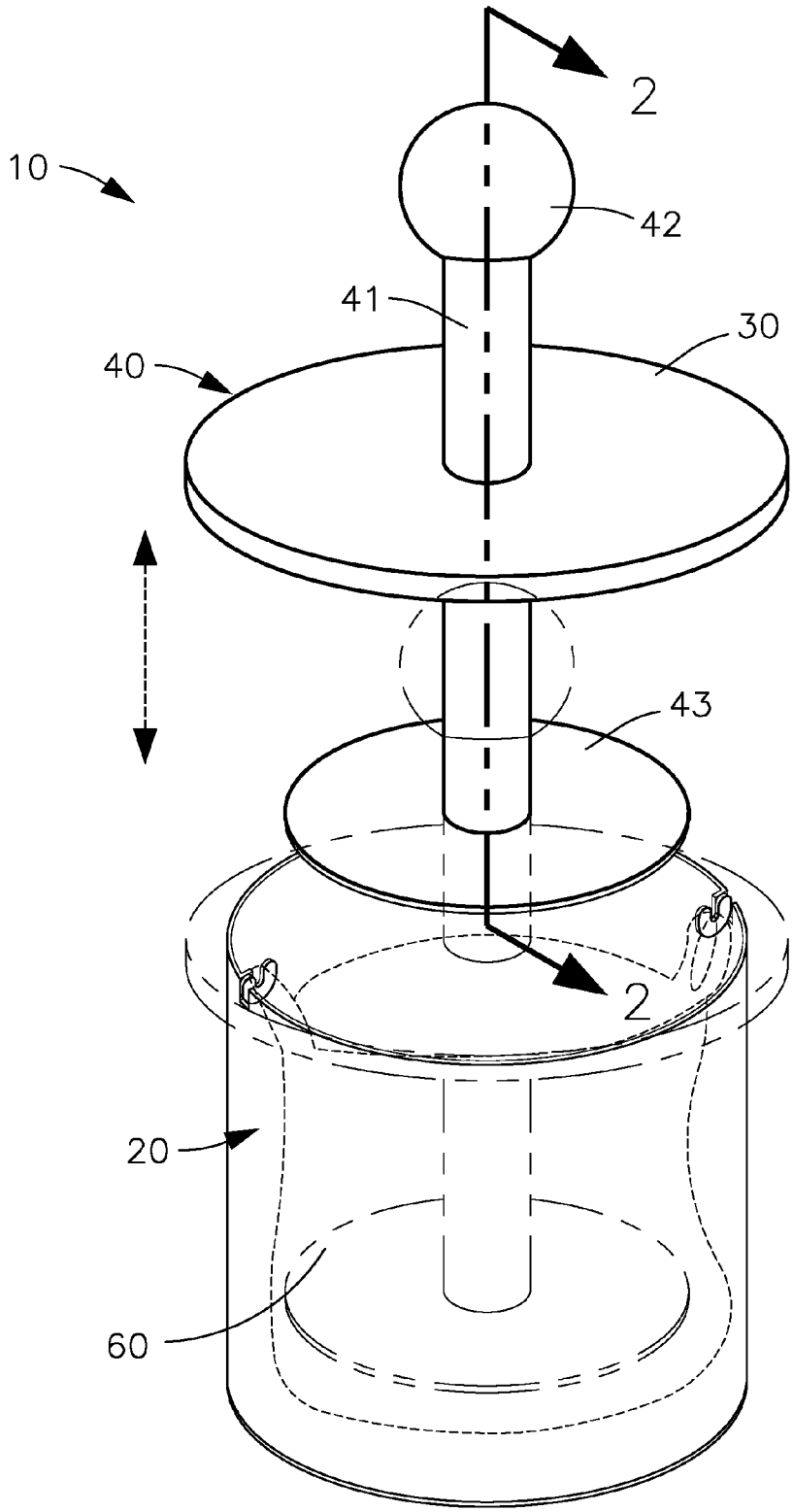
FIG. 1 is a perspective view showing a compression implement linearly reciprocated within a waste receptacle holding a trash bag therein, in accordance with a first embodiment of the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-7 by the reference numeral 10 and is intended to provide a waste receptacle compression system. It should be understood that the manually-actuated waste compression system 10 may be used to compact their garbage without having to make direct contact therewith.

In a preferred embodiment of the present invention, the manually-actuated waste compressing system 10 may preferably include a waste receptacle 20. The waste receptacle 20 has a waste bag 60 removably seated therein, which is adapted to house the waste during compression procedures. The present invention further includes a lid 30 removably mated to the waste receptacle 20. A manually-actuated compression implement 40 may be linearly reciprocated along a linear travel path defined along a longitudinal length of the waste receptacle 20. In this way, the compression implement 40 may be centrally aligned within an inner perimeter of the waste receptacle 20 during reciprocating movements of the compression implement 40.

Figure 2:
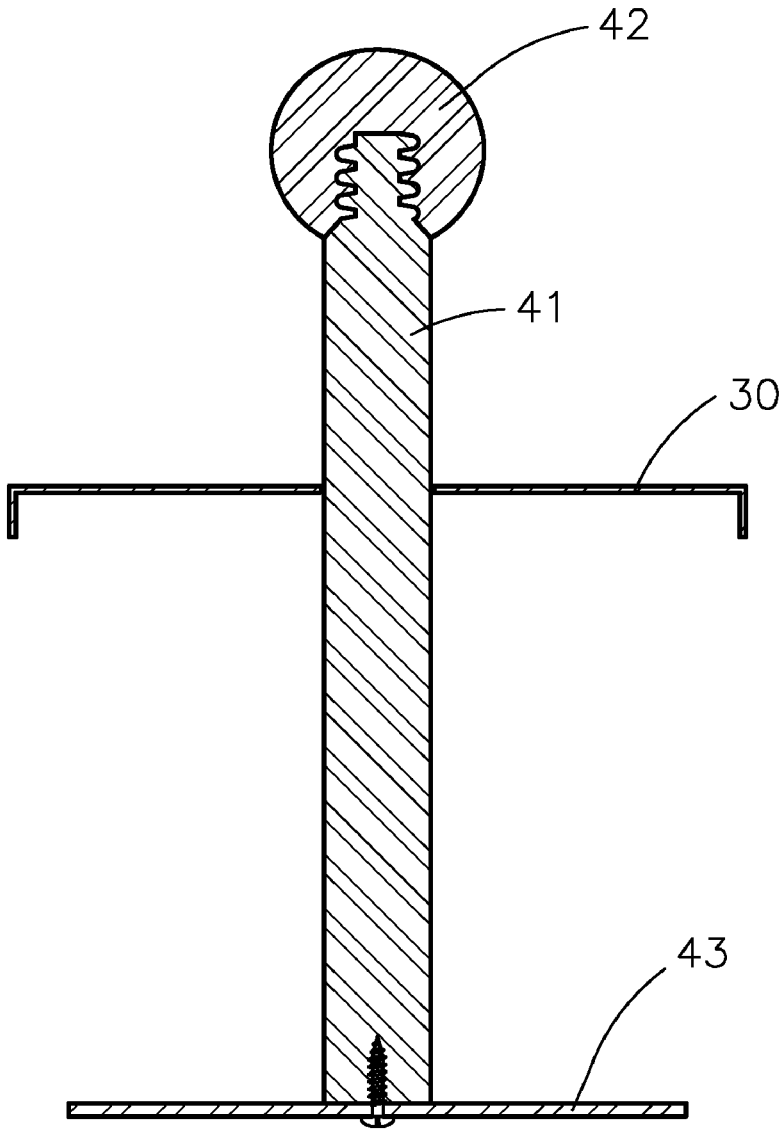
FIG. 2 is a cross-sectional view of the compression implement take along line 2-2 as shown in FIG. 1.

Referring to FIG. 1 and FIG. 2, one embodiment of the compression implement 40 may include an elongated rectilinear dowel 41 provided with a knob 42 attached to its proximal end, and a disc 43 situated subjacent to the lid 30. The disc 43 may be coupled to a distal end of the dowel 41 wherein the disc 43 is suitably sized and shaped to linearly slide within close proximity of the inner perimeter of the waste receptacle 20. The disc 43 may be further adapted to downwardly compact the waste within the waste bag 60 while the lid 30 remains elevated above the waste receptacle 20.

In addition, the lid 30 may be statically mated to the compression implement 40 and thereby removably engaged with a top opening of the receptacle as the disc 43 is reciprocated along the linear travel path. The lid 30 and the disc 43 may preferably have fixed diameters and may be coaxially spaced apart along a longitudinal length of the dowel 41 such that the disc 43 and the lid 30 may be synchronously displaced along the linear travel path as the dowel 41 is reciprocated along the linear travel path.

Figure 3:
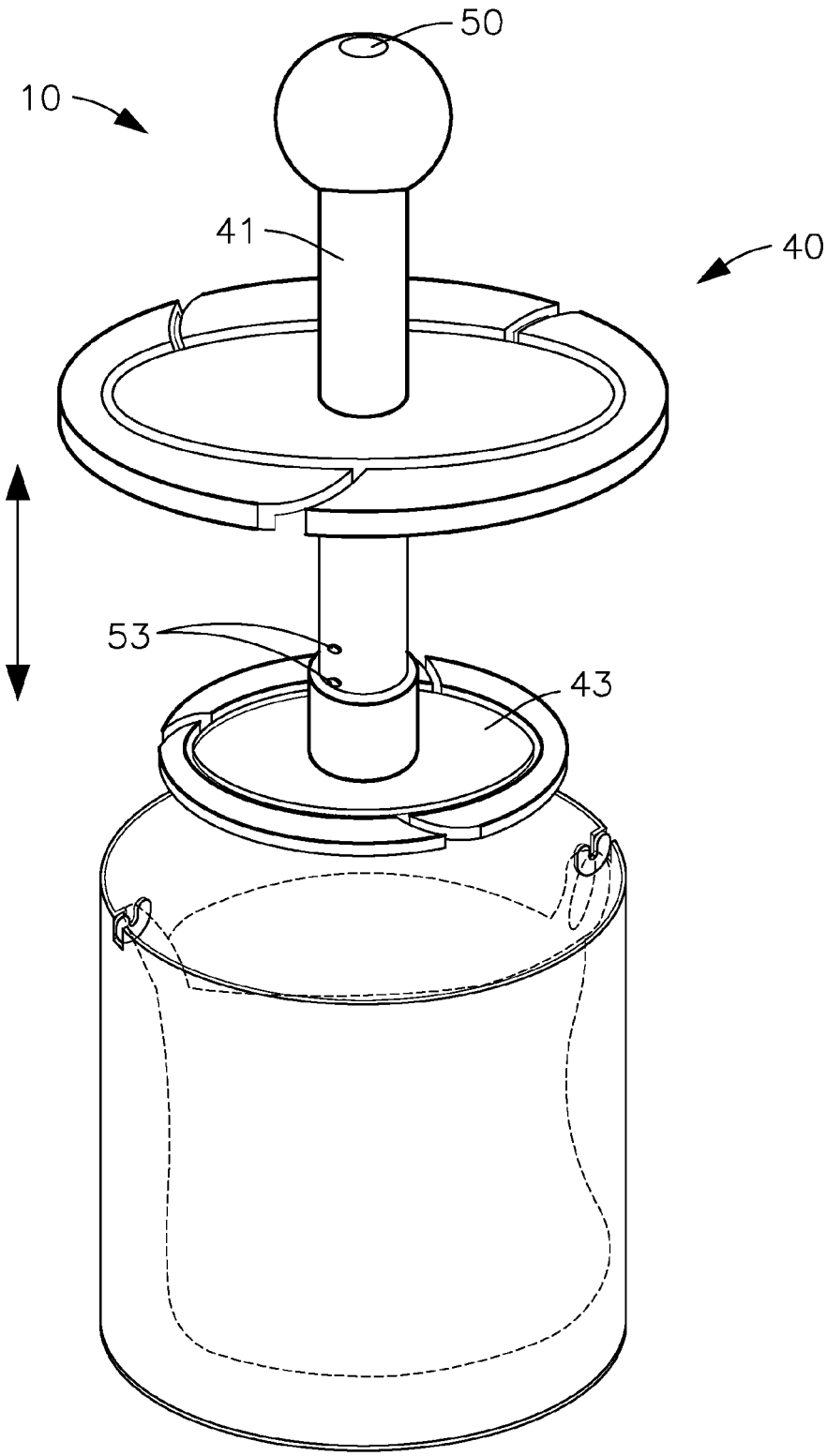
FIG. 3 is a perspective view showing an alternate embodiment of the present invention.
Figure 4:
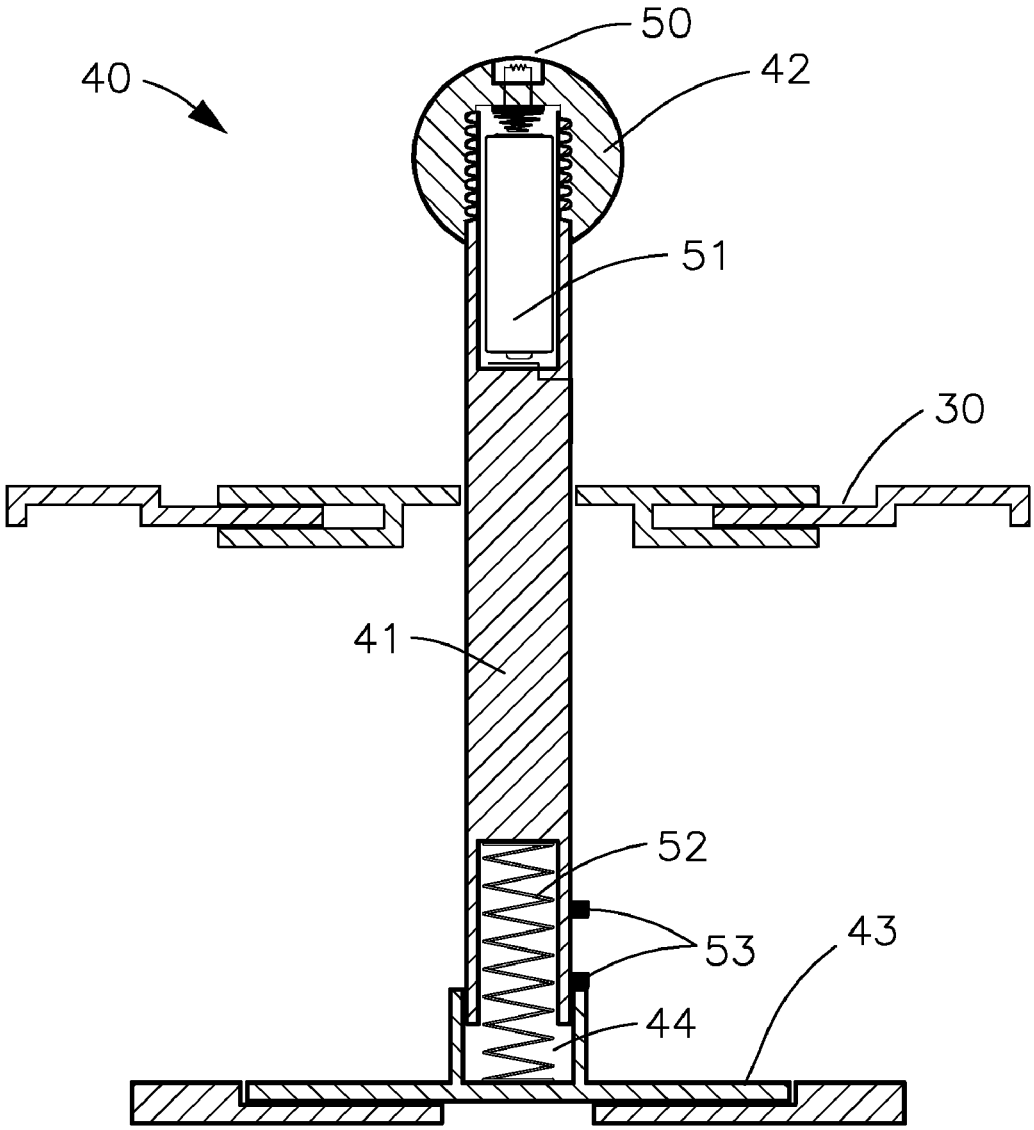
FIG. 4 is a cross-sectional view of the compression implement taken along line 4-4 as shown in FIG. 3.

Referring to FIG. 3 and FIG. 4, one embodiment of the compression implement 40 may include a light-emitting source 50 located at the knob 42 and a power supply source 51 electrically coupled to the light-emitting source 50. A deformably resilient spring member 52 preferably having axially opposed ends may further be directly anchored to an inner chamber 44 of the dowel 41 and the disc 43 respectively such that the spring member 52 may exert a resistive force against a linear motion of the dowel 41.

Further, a pair of conductive contacts 53 may be statically connected to the dowel 41 and the disc 43 respectively. In this way, when the spring member 52 is reciprocated between compressed and equilibrium positions as the dowel 41 is linearly reciprocated along the linear travel path. In this manner, the contacts may be directly engaged when the spring member 52 is compressed along the linear travel path such that the light emitting source is illuminated when the contacts are directly engaged. Such a structural configuration advantageously notifies a user of a maximum bottom displacement point of the dowel 41 during compression procedures for solving the problem of inadvertently tearing the waste bag 60.

Figure 5:
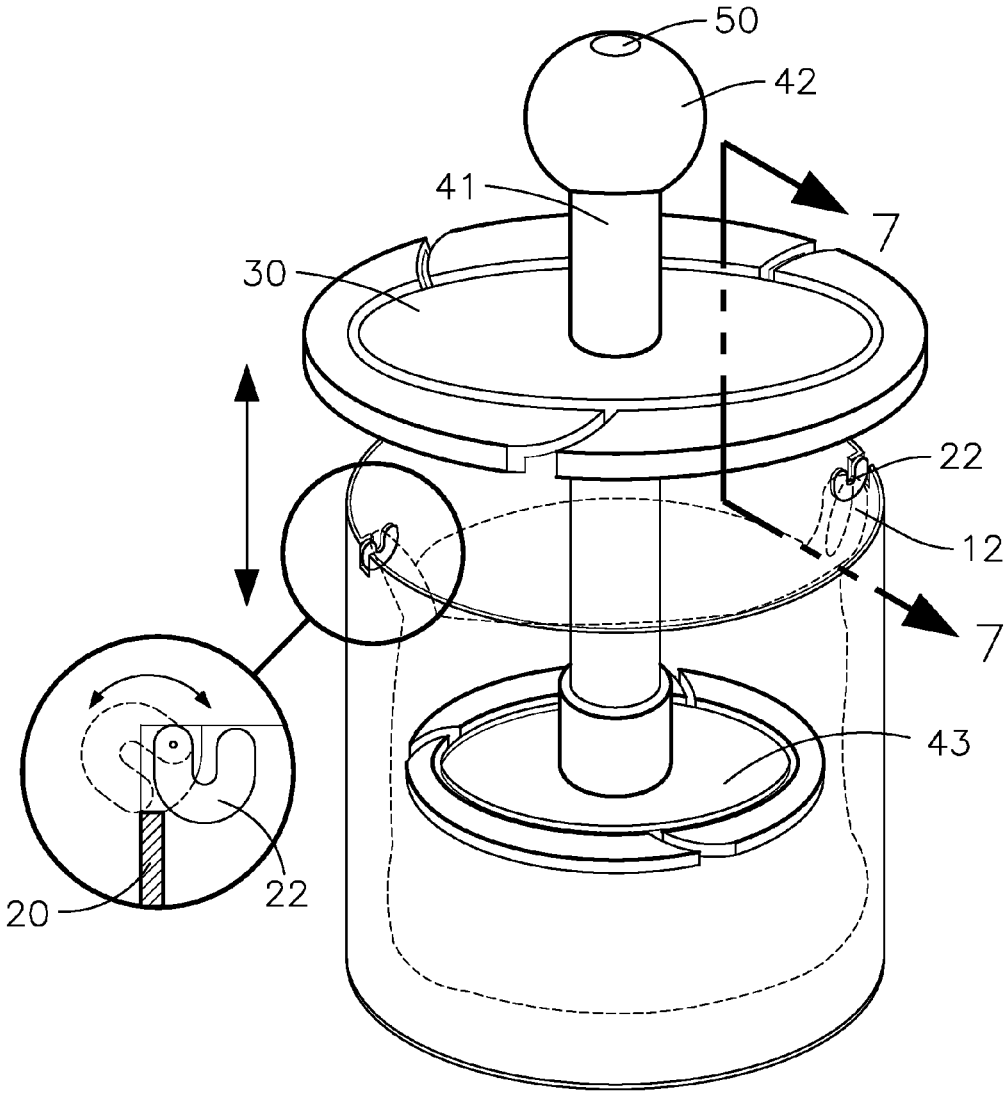
FIG. 5 is a perspective view showing yet another embodiment of the present invention wherein a pair of hooks are pivotally connected to a perimeter of the waste receptacle.
Figure 6:
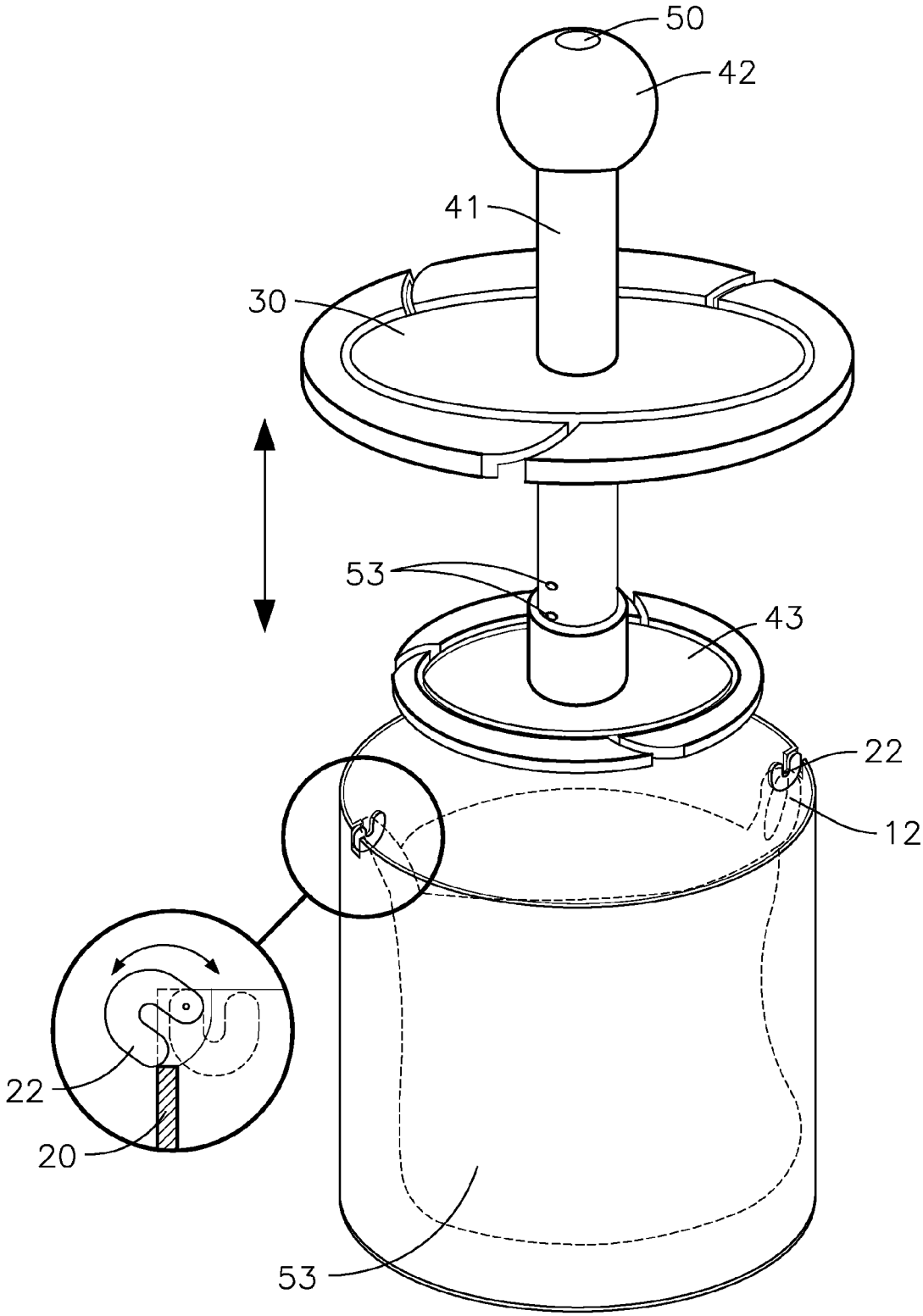
FIG. 6 is a perspective view showing the pivotal rotation of the hooks.

Referring to FIG. 5 and FIG. 6, one embodiment of the present invention discloses a plurality of hooks 22 oppositely located at an open top end of the receptacle 20. The waste bag 60 may have a pair of upper flanges 12 removably mated to the hooks 22 respectively such that the waste bag 60 is held at an upright position for receiving the waste therein. The hooks 22 may be diametrically opposed along the inner perimeter of the open top end such that they are caused to automatically rotate inwardly from the inner perimeter of the waste receptacle 20 when the compression implement 40 is removed from the waste receptacle 20.

In addition, the hooks 22 are rotatably urged along mutually exclusive arcuate paths and thereby face outwardly away from the inner perimeter when the disc 43 is lowered into the waste receptacle 20. In this way, the waste bag 60 may be tensioned when the hooks 22 rotate outwardly away from the inner perimeter so that the disc 43 evenly compresses the waste towards a bottom end of the waste bag 60.

Figure 7:
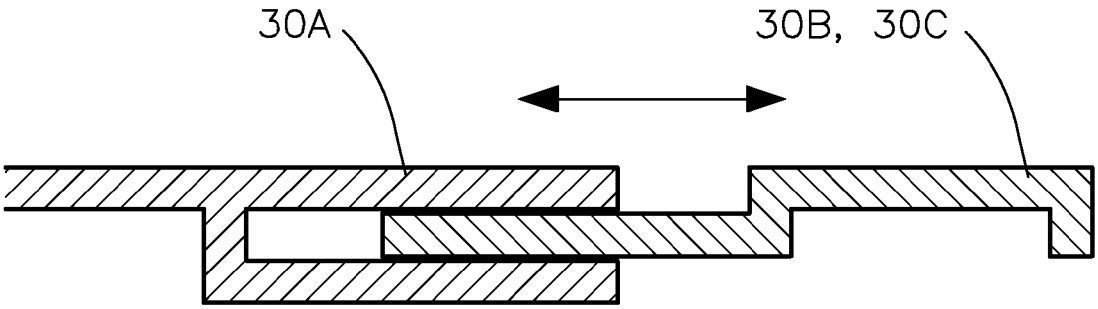
FIG. 7 is an enlarged cross-sectional view taken along line 7-7 of the lid wherein the inner and outer rings are slidably adjustable.

As best shown in FIG. 7, both the disc 43 and the lid 30 may include an inner ring 30A concentrically positioned about the dowel 41 and an outer ring rotatably mated to the inner ring and spaced away from the dowel 41. For example, the lid 30 may include an inner ring 30A concentrically positioned about the dowel 41 and an outer ring 30B rotatably mated to the inner ring 30A and spaced away from the dowel 41. The inner ring 30A may preferably have a predetermined fixed diameter.

The outer ring 30B may preferably include a plurality of arcuate segments 30C dynamically arranged at an end-to-end pattern extending along a circumference of the outer ring 30B with each of the arcuate segments 30C. Such arcuate segments 30C are preferably equidistantly offset from a center of the inner ring 45. Such a configuration may preferably allow a diameter of the outer ring 30B to uniformly increase and decrease as the arcuate segments 30C are spatially separated and connected at the end-to-end pattern respectively. Additionally, the outer ring 30B diameters associated with the lid 30 and the disc 43 are independently increased and decreased as desired by the user.

The invention may further include a method of utilizing a manually-actuated waste compressing system 10 for effectively compacting waste in a space-limited target zone. The method may preferably comprise the chronological steps of: providing a waste receptacle 20; providing and removably seating a waste bag 60 within the waste receptacle 20 wherein the waste bag 60 is adapted to house the waste therein; providing and removably mating a lid 30 to the waste receptacle 20; providing and linearly reciprocating a manually-actuated compression implement 40 along a linear travel path defined along a longitudinal length of the waste receptacle 20 such that the compression implement 40 is centrally aligned within an inner perimeter of the waste receptacle 20 during reciprocating movement.

The method may further provide a compression implement 40 having an elongated rectilinear dowel 41 provided with a knob 42 attached to a proximal end thereof. Such a compression implement 40 further including a disc 43 situated subjacent to the lid 30 and coupled to a distal end of the dowel 41.

Further, the method may provide a lid 30 statically mated to the compression implement 40; compacting the waste by downwardly compacting the disc 43 within the waste bag 60 and thereby linearly sliding the disc 43 within close proximity of the inner perimeter of the waste receptacle 20 while the lid 30 remains elevated above of the waste receptacle 20. In addition, the method may provide for removably engaging the lid 30 with a top opening of the receptacle as the disc 43 is reciprocated along the linear travel path.

The present invention, as claimed, provides the unexpected and unpredictable benefit of compacting garbage without having to make direct contact therewith. The invention additionally allows a user to utilize a waste receptacle more efficiently as more garbage is stored inside the waste receptacle before the garbage has to be disposed off. Further, the light source alerts a user when an optimum compression of the garbage is reached such that the compression implement and waste receptacle do not tear the waste bag 60. The combination of such claimed elements provides an unpredictable and unexpected result which is not rendered obvious by one skilled in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A manually-actuated waste compressing system for effectively compacting waste in a space-limited target zone, said waste compressing system comprising:

a waste receptacle having a waste bag removably seated within said waste receptacle wherein said waste bag is adapted to house the waste therein;

a lid removably mated to said waste receptacle; and a manually-actuated compression implement linearly reciprocated along a linear travel path defined along a longitudinal length of said waste receptacle such that said compression implement is centrally aligned within an inner perimeter of said waste receptacle during reciprocating movement, said compression implement comprising an elongated rectilinear dowel provided with a knob attached to a proximal end thereof, and a disc situated subjacent to said lid and being coupled to a distal end of said dowel;

wherein said disc is suitably sized and shaped to linearly slide within close proximity of said inner perimeter of said waste receptacle such that said disc is adapted to downwardly compact the waste within said waste bag while said lid remains elevated above of said waste receptacle;

wherein said compression implement further comprises a light-emitting source located at said knob;

a power supply source electrically coupled to said light-emitting source;

a deformably resilient spring member having axially opposed ends directly anchored to an inner chamber of said dowel and said disc respectively, said spring member exerting a resistive force against a linear motion of said dowel; and a pair of conductive contacts statically connected to said dowel and said disc respectively;

wherein said spring member is reciprocated between compressed and equilibrium positions as said dowel is linearly reciprocated along said linear travel path, said contacts being directly engaged when said spring member is compressed along said linear travel path;

wherein said light-emitting source is illuminated when said contacts are directly engaged so that a user learns of a maximum bottom displacement point of said dowel during compression procedures.

2. The manually operated waste compressing system of claim 1, wherein said lid and said disc have fixed diameters and are coaxially spaced apart along a longitudinal length of said dowel, said disc being displaced along the linear travel path as said dowel is reciprocated along said linear travel path.

3. The manually operated waste compressing system of claim 1, further comprising:

a plurality of hooks oppositely located at an open top end of said waste receptacle, said waste bag having a pair of upper flanges removably mated to said hooks respectively such that said waste bag is held at an upright position for receiving the waste therein;

wherein said hooks are diametrically opposed along said inner perimeter of said open top end and are caused to automatically rotate inwardly from said inner perimeter of said waste receptacle when said compression implement is removed from said waste receptacle;

wherein said hooks are rotatably urged along mutually exclusive arcuate paths and thereby face outwardly away from said inner perimeter when said disc is lowered into said waste receptacle, said waste bag being tensioned when said hooks rotate outwardly away from said inner perimeter so that said disc evenly compresses the waste towards a bottom end of said waste bag.

4. The manually operated waste compressing system of claim 1, wherein each of said disc and said lid comprises:

an inner ring concentrically positioned about said dowel; and an outer ring rotatably mated to said inner ring and spaced away from said dowel;

wherein said outer ring includes a plurality of arcuate segments dynamically arranged at an end-to-end pattern extending along a circumference of said outer ring, each of said arcuate segments being equidistantly offset from a center of said inner ring such that a diameter of said outer ring is uniformly increased and decreased as said arcuate segments are spatial separated and connected at said end-to-end pattern respectively;

wherein said inner ring has a predetermined fixed diameter.

5. The manually operated waste compressing system of claim 4, wherein each said diameters of said outer rings associated with said lid and said disc are independently increased and decreased as desired by the user.

6. A manually-actuated waste compressing system for effectively compacting waste in a space-limited target zone, said waste compressing system comprising:

a waste receptacle having a waste bag removably seated within said waste receptacle wherein said waste bag is adapted to house the waste therein;

a lid removably mated to said waste receptacle; and a manually-actuated compression implement linearly reciprocated along a linear travel path defined along a longitudinal length of said waste receptacle such that said compression implement is centrally aligned within an inner perimeter of said waste receptacle during reciprocating movement, said compression implement comprising an elongated rectilinear dowel provided with a knob attached to a proximal end thereof, and a disc situated subjacent to said lid and being coupled to a distal end of said dowel;

wherein said disc is suitably sized and shaped to linearly slide within close proximity of said inner perimeter of said waste receptacle such that said disc is adapted to downwardly compact the waste within said waste bag while said lid remains elevated above of said waste receptacle;

wherein said lid is statically mated to said compression implement and is thereby removably engaged with a top opening of said receptacle as said disc is reciprocated along said linear travel path;

wherein said compression implement further comprises a light-emitting source located at said knob;

a power supply source electrically coupled to said light-emitting source;

a deformably resilient spring member having axially opposed ends directly anchored to an inner chamber of said dowel and said disc respectively, said spring member exerting a resistive force against a linear motion of said dowel; and a pair of conductive contacts statically connected to said dowel and said disc respectively;

wherein said spring member is reciprocated between compressed and equilibrium positions as said dowel is linearly reciprocated along said linear travel path, said contacts being directly engaged when said spring member is compressed along said linear travel path;

wherein said light-emitting source is illuminated when said contacts are directly engaged so that a user learns of a maximum bottom displacement point of said dowel during compression procedures.

7. The manually operated waste compressing system of claim 6, wherein said lid and said disc have fixed diameters and are coaxially spaced apart along a longitudinal length of said dowel, said disc being displaced along the linear travel path as said dowel is reciprocated along said linear travel path.

8. The manually operated waste compressing system of claim 6, further comprising:

a plurality of hooks oppositely located at an open top end of said waste receptacle, said waste bag having a pair of upper flanges removably mated to said hooks respectively such that said waste bag is held at an upright position for receiving the waste therein;

wherein said hooks are diametrically opposed along said inner perimeter of said open top end and are caused to automatically rotate inwardly from said inner perimeter of said waste receptacle when said compression implement is removed from said waste receptacle;

wherein said hooks are rotatably urged along mutually exclusive arcuate paths and thereby face outwardly away from said inner perimeter when said disc is lowered into said waste receptacle, said waste bag being tensioned when said hooks rotate outwardly away from said inner perimeter so that said disc evenly compresses the waste towards a bottom end of said waste bag.

9. The manually operated waste compressing system of claim 6, wherein each of said disc and said lid comprises:

an inner ring concentrically positioned about said dowel; and an outer ring rotatably mated to said inner ring and spaced away from said dowel;

wherein said outer ring includes a plurality of arcuate segments dynamically arranged at an end-to-end pattern extending along a circumference of said outer ring, each of said arcuate segments being equidistantly offset from a center of said inner ring such that a diameter of said outer ring is uniformly increased and decreased as said arcuate segments are spatial separated and connected at said end-to-end pattern respectively;

wherein said inner ring has a predetermined fixed diameter.

10. The manually operated waste compressing system of claim 9, wherein each said diameters of said outer rings associated with said lid and said disc are independently increased and decreased as desired by the user.

* * * * *